United States Patent [19]

Baskent

[11] Patent Number: 4,768,251

[45] Date of Patent: Sep. 6, 1988

[54] MATTRESS PAD

[75] Inventor: Feyyaz O. Baskent, Capistrano Beach, Calif.

[73] Assignee: Convo Corporation, Gardena, Calif.

[21] Appl. No.: 31,573

[22] Filed: Mar. 30, 1987

[51] Int. Cl.[4] ..... A47C 27/14

[52] U.S. Cl. ..... 5/464; 5/468; 5/481

[58] Field of Search ..... 5/481, 468, 464, 465, 5/420; 297/DIG. 1

[56] References Cited

U.S. PATENT DOCUMENTS

| | | | |
|---|---|---|---|
| 3,521,311 | 7/1970 | Cohen | 5/464 |
| 3,604,025 | 9/1971 | Mims | 5/464 |
| 3,742,528 | 7/1973 | Munch | 5/464 |
| 4,383,342 | 5/1983 | Forster | 5/448 |
| 4,620,337 | 4/1986 | Williams et al. | 5/468 |
| 4,628,557 | 12/1986 | Murphy | 5/464 |

FOREIGN PATENT DOCUMENTS

| | | | |
|---|---|---|---|
| 639546 | 4/1983 | Switzerland | 5/464 |
| 1559851 | 1/1980 | United Kingdom | 5/464 |

*Primary Examiner*—Alexander Grosz
*Attorney, Agent, or Firm*—Harlan P. Huebner

[57] ABSTRACT

A mattress pad particularly adopted to prevent decubitus ulcers of a person laying thereon wherein there are a head section and a feet and legs section having similar top configurations and an intermediate torso support insert section therebetween of a top configuration different than said other two sections. The insert section is capable of being a replaceable insert within said pad or permanently affixed thereto.

7 Claims, 1 Drawing Sheet

MATTRESS PAD

BACKGROUND OF THE INVENTION

1. Field of the Invention

This invention relates to a mattress pad particularly adopted to prevent decubitus ulcers of a bedridden person wherein the mattress pad utilized polyurethane foam of differing stiffnesses.

2. Description of the Prior Art

Mattress pads of convoluted polyurethane foam such as disclosed in U.S. Pat. No. 3,258,791 have been known and used for many years. In such a case the convolutions extend over the entire top surface of the mattress pad and the peaks of the convolutions are all generally co-planar as are the bottom of the valleys between the peaks. The difficulty with such structure is that the stiffness or density of the foam is the same over the entire area with no particular effort to consider the weightier part of a body such as the torso. Certain areas of the body have a tendency to compress the peaks more than others so that there is really no airspace between the body and the mattress. Such a situation would foster decubitus ulcers (bed sores) of bedridden patients instead of prevention of the same.

In U.S. Pat. No. 3,604,025 the foam bedding for box spring and mattress use does have areas of differential resistance to weight. However, there are no convolutions for the passage of air and thus decubitus ulcers are not prevented.

Turning now to U.S. Pat. No. 4,620,337 this convoluted foam mattress also does not solve the problem. In this patent there are convoluted ends for the head and feet and the ends taper upwardly. The upward taper appears to be required to present more material so that the convolutions are not flattened all the way. As for the center section of the mattress there are a plurality of ribs that extend between the end portions. However, there is no indication that the density or stiffness of the center section differs from the end sections to present a firmer area for the torso. The entire mattress pad is of a single piece construction with the same density of foam throughout. Such construction does not truly lend itself to complete prevention of decubitus ulcers.

SUMMARY OF THE INVENTION

It is a purpose of the present invention to provide a mattress pad for hospital or other beds wherein there are head and feed and legs sections of convoluted polyurethane foam and a torso insert section of different construction which may also be of different density and ILD. Density when referring to foam, is a unit of weight per specific volume and presented as pounds per cubic feed ($lb/ft^3$) or kilograms per cubic meter ($kg/m^3$). Higher density foams for decubitus management are invariably more satisfactory than the lower density foams for the reasons of increase support (per square inch) and decrease fatigue properties (foam softening). On the other hand ILD refers to "Indentation Load Deflection", it is the degree of foam support characteristics. The degree of foam firmness at different compressions is affected by density and the particular chemical formulation.

The other criteria which determines the support or comfort factor is the ratio between 65% to 25% IFD. The higher the ratio the better the foam comfort, and more reduction on pressure points for decubitus pads are obtained.

An object of the present invention is to increase comfort factor which may be accomplished by the lamination of two significantly different urethanes to decrease pressure points and at the same time increase support for the user.

Another object of the present invention is to provide a mattress pad wherein the center torso supporting portion is changeable to accommodate bodies of different weight.

A further object of the present invention is to provide a center torso supporting portion of a mattress pad which may or may not be of laminated construction but does have an upper "waffle weave" construction for proper support.

A still further object of the present invention is to provide a center torso supporting insert for a mattress pad which may be permanently affixed to the mattress pad.

These and other objects and advantages will become apparent from the following part of the specification wherein details have been described for the competence of disclosure, without intending to limit the scope of the invention which is setforth in the appended claims.

BRIEF DESCRIPTION OF THE DRAWINGS

These advantages may be more clearly understood from the following detailed description and by reference to the drawings in which.

DETAILED DESCRIPTION OF THE PREFERRED EMBODIMENT

Figure 1:
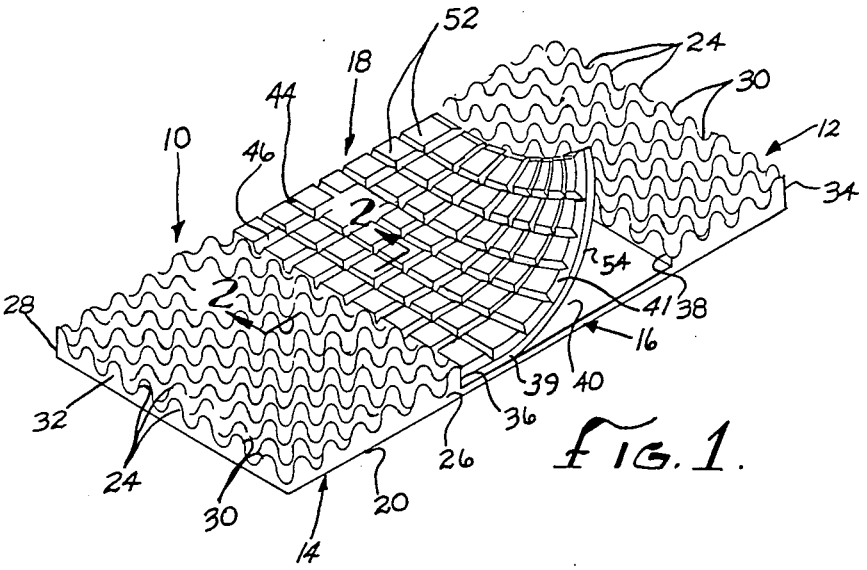
FIG. 1 is a perspective view of a mattress pad of the present invention.

In FIG. 1 there is illustrated a mattress pad generally designated 10 preferably formed of polyurethane foam. The pad 10 is usually placed upon a bed in a hospital or elsewhere and is particularly useful for patients that are bed ridden and might suffer from decubitus ulcers, otherwise known commonly as bed sores. In view of the construction of the mattress pad 10 there are air spaces and air passages within the mattress pad to allow the circulation of air under a patient whereby decubitus ulcers may be prevented.

The mattress pad 10 is preferably of a length and width to fit over a conventional mattress and corresponds to the perimeter dimension of such a mattress as for example a single bed, double bed, etc.

The mattress pad 10 includes a head section generally designated 12 and a feet and legs section generally designated 14. Uniting the two sections 12 and 14 is a torso bridge section designated 16 and mounted on the torso bridge section 16 is a torso support insert member generally designated 18.

The head, feet, and legs sections 12 and 14 include a bottom surface 20 that is common along the entire mattress pad 10. Each of the sections 12 and 14 include convolutions of foam 22 that project upwardly and include a number of peaks 24 that may be arranged in rows across the mattress pad 10 from side 26 to side 28. The peaks 24 are separated by valleys 30 between the rows of peaks.

The process of forming convoluted foam such as illustrated and described is well known in the art and does not form a part of the present invention.

As can be seen by the drawing the convolutions formation allow air to pass around the peaks 24 through the valleys 30.

The head section 12 and feet and legs section 14 are both formed with convolutions 22. The only preferably difference resides in the preferred length of each section. The feet and legs section 14 is longer than the head section 12 as best seen in FIG. 1. This allows for an accommodation of a patient's feet and legs to a point above the knees whereas the head portion 12 made be shorter as it is to accommodate the head and possibly the shoulders only of the patient.

Each section 12 and 14 terminates inwardly of bottom end 32 and top end 34 respectively in inner ends 36 and 38. The inner ends 36 and 38 terminate at inner cut out top surface 40 forming the recess torso bridge section 16 between the top surface 40 and bottom surface 20.

Thus, as can be seen there is a cut-out or recess 42 formed between ends 36 and 38 and top surface 40. Mounted within the cut-out 42 is the torso support insert member 18.

The torso support insert member 18 is of a peripheral dimension to fit between sides 26 and 28 and ends 36 and 38. The insert member 18 is also preferably of laminated layers 39 and 41 of polyurethane. The ILD and density of both of the laminants 39 and 41 are of different construction than the head and feet and legs sections 12 and 14 due to the fact that the torso of a patient will lay thereupon.

The insert member 18 preferably includes a "waffle weave" construction on the top surface of upper laminant 41. The construction includes a plurality of parallel spaced apart grooves such as V shaped grooves 44 running in a first direction such as across the pad 10 from side 26 to 28. In addition, there are a plurality of parallel spaced apart grooves such as V shaped grooves 46 running normal to the grooves 44 and crossing the same between ends 36 and 38 of sections 12 and 14.

Figure 2:
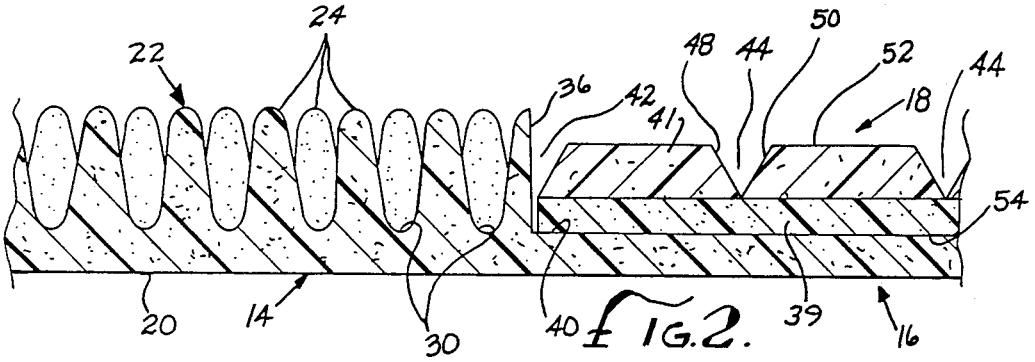
FIG. 2 is a side elevational view of the present invention taken on line 2—2 of FIG. 1.

Each of the grooves 44 and 46 include side walls 48 and 50, see FIG. 2 and formed between intersecting grooves 44 and 46 are formed a number of rectangular support squares 52. The angle of the side walls 48 and 50 can be angularly varied to increase or decrease air flow as well as change the support characteristic of the insert 18.

The insert member 18 also includes a bottom surface 54 which rests on the inner cut-out top surface 40 of the torso bridge section 16.

With the construction just described it will be see that the grooves 44 and 46 will act as passages and allow air circulation to prevent the formation of decubitus ulcers.

Depending upon the weight of the patient the insert section 18, which supports the heaviest part of the body, may vary in hardness (ILD) and density. In other words, the stiffness may vary so that the rectangular support squares 52 will not be crushed completely flat and close off the grooves 44 and 46 and remain that way losing resiliency. In addition, with the interchangeable feature the patient mattress pad 10 may be sterilized and reused with a different insert member 18 for a different patient. Also the interchangability allows the tailoring of mattress pads 10 to individuals weights.

Figure 3:
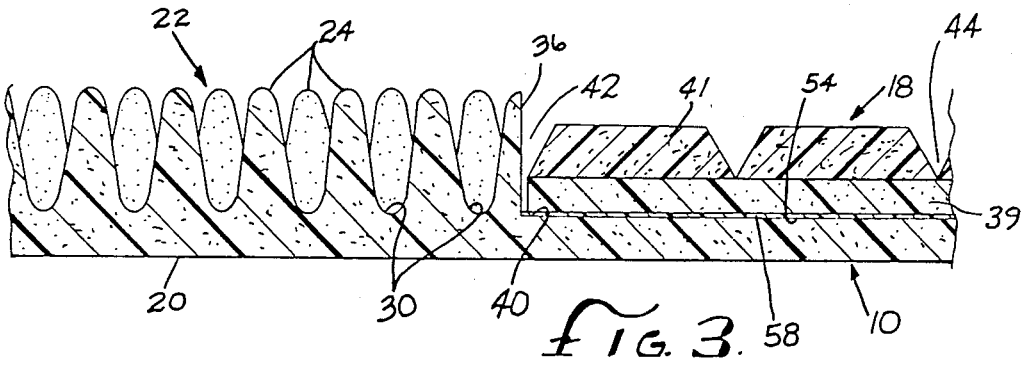
FIG. 3 is a side elevational view of a modification of the present invention similar to FIG. 2.

In FIG. 3 there is illustrated a modified form of the patient mattress pad 10 wherein all the parts remain of the same construction. The difference resides in the fact that the insert member 18 is permanently affixed within the cut out or recess 42 by means of an adhesive 58. The adhesive 58 bonds the bottom 54 and the inner cut out top surface 40 together.

The modification of FIG. 3 is particularly useful where only one person or patient plans to use the mattress pad 10 or it is known that the pad 10 will be used for an indefinite period of time.

While the insert 18 is preferably constructed of laminated foam as above described, it should be realized that the insert 18 may be of a single piece of foam without departing from the spirit of the invention.

The invention and its attendant advantages will be understood from the foregoing description and it will be apparent that various changes may be made in the form, construction and arrangements of the parts without departing from the spirit and scope thereof or sacrificing its material advantages, the arrangements herein before described being merely by way of example. I do not wish to be restricted to the specific forms shown or uses mentioned, except as defined in the accompanying claims, wherein various portions have been separated for clarity of reading and not for emphasis.

I claim:

1. A mattress pad defined by a head end, opposed foot end and parallel sides extending therebetween adopted to prevent decubitus ulcers of a person laying thereon wherein there is a head section and a feet and legs section formed of polyurethane each having an upper surface of convolutions including peaks and valleys wherein air may pass around the convolutions throughout the area of the sections so that the extremities of a person resting upon said sections are in an elevated position, the improvement comprising:

a torso bridge section extending between and uniting said head section and said feet and legs section and of a width extending between said parallel sides said bridge section being recessed having a top surface below the top of said peaks of said convolutions and having open sides;

a torso support insert member of polyurethane inserted in said recess and extending between and to said sides, said member having a plurality of intersecting grooves that define air passages, at least some of said air passages extending to said sides, with a height complimentary with the top of said peaks and of a top surface configuration different than the tops of said head section and said feet and legs section, and said insert member being the same or a greater stiffness than the stiffness of said convolutions of said head section and said feet and legs section whereby the torso of said person may be supported to overlie said air passages without collapsing them; and the tops of said peaks of said head section and said feet and legs section being of complimentary horizontal heights.

2. A mattress pad as defined in claim 1 wherein:

said torso support insert section includes a waffle weave top surface construction presenting generally flat support squares;

said air passages include parallel spaced apart grooves running in a first direction between said parallel sides;

additional parallel spaced apart grooves running in a second direction normal to and crossing said grooves running in said first direction; and said flat support squares formed between said crossing grooves.

3. A mattress pad as defined in claim 2 wherein: said air passages are V shaped grooves in cross section and the angle of the walls of said grooves may vary to create an air passage area of a varying cross section.

4. A mattress pad as defined in claim 2 wherein said torso support insert section has a higher indentation load deflection (ILD) than said head section and said feet and legs sections, whereby the greater weight of a torso will not cause the insert section to close said air passages.

5. A mattress pad as defined in claim 1 wherein said insert member is fixedly mounted in said recess.

6. A mattress pad as defined in claim 1 wherein said insert member is loosely mounted in said recess whereby the same may be interchanged with another insert member.

7. A mattress pad as defined in claim 1 wherein said torso support insert member includes upper and lower laminated portions.

* * * * *

UNITED STATES PATENT AND TRADEMARK OFFICE

CERTIFICATE OF CORRECTION

PATENT NO. : 4,768,251

DATED : September 6, 1988

INVENTOR(S) : Feyyaz O. Baskent

It is certified that error appears in the above-identified patent and that said Letters Patent are hereby corrected as shown below:

Title page, Item [73] should read as follows:

-- Assignee: G R FOAM PRODUCTS, INC., Orange, Calif. --.

Signed and Sealed this

Seventh Day of February, 1989

*Attest:*

DONALD J. QUIGG

*Attesting Officer*

*Commissioner of Patents and Trademarks*